US011350755B2

(12) United States Patent
Hu

(10) Patent No.: US 11,350,755 B2
(45) Date of Patent: Jun. 7, 2022

(54) FOLDABLE CHAIR

(71) Applicant: Ninghai Xingda Leisure Products Co., Ltd., Shenzhen Town (CN)

(72) Inventor: Jinxue Hu, Shenzhen Town (CN)

(73) Assignee: Ninghai Xingda Leisure Products Co., Ltd., Shenzhen (CN)

( * ) Notice: Subject to any disclaimer, the term of this patent is extended or adjusted under 35 U.S.C. 154(b) by 0 days.

(21) Appl. No.: 17/301,328

(22) Filed: Mar. 31, 2021

(65) Prior Publication Data

US 2021/0386204 A1 Dec. 16, 2021

(30) Foreign Application Priority Data

Jun. 10, 2020 (CN) ..... 202010523625.1

(51) Int. Cl.
*A47C 5/10* (2006.01)
*A47C 9/10* (2006.01)
(Continued)

(52) U.S. Cl.
CPC ..... *A47C 5/10* (2013.01); *A47C 4/14* (2013.01); *A47C 4/24* (2013.01); *A47C 4/28* (2013.01);
(Continued)

(58) Field of Classification Search
CPC .... A47C 5/10; A47C 4/14; A47C 4/24; A47C 4/28; A47C 4/30; A47C 4/38; A47C 4/48; A47C 9/10; A47C 4/022; A47C 4/028; A47C 13/00; A47C 4/02; A47C 4/50; A47C 4/283; A47C 4/286; A45B 5/00
See application file for complete search history.

(56) References Cited

U.S. PATENT DOCUMENTS 8,454,084 B2 * 6/2013 Lah ..... A47C 4/02 297/16.2
8,899,686 B1 * 12/2014 Kim ..... A47C 4/286 297/440.11
(Continued)

FOREIGN PATENT DOCUMENTS

EP 3766386 A1 * 1/2021 ..... A47C 4/02
JP 2021194532 A * 12/2021
(Continued)

*Primary Examiner* — Robert Canfield
(74) *Attorney, Agent, or Firm* — Wang Law Firm, Inc.

(57) ABSTRACT

A foldable chair, comprises a foldable chair frame (10) and a chair seat (1) made of a flexible material; the chair frame (10) comprising an X-shaped left support frame (101), an X-shaped right support frame (102) connected through a connecting crossbar (3), the chair seat (1) is connected to the chair frame (10) through a plurality of connecting pieces; a detachable pole (2) extends from top to bottom of the chair frame (10), and the connecting crossbar (3) has two first through holes (34) for the poles (2) to pass through; correspondingly, the connecting crossbar (3) has two second through holes (33) for a plurality of support tubes (100) to pass through; each pole (2) and the corresponding support tube (100) forms the X-shaped left or right support frame. This chair has the advantages of simple and reasonable structure, easy installation and disassembly, simple manufacture process and low cost, and is especially suitable for carrying around when traveling.

7 Claims, 5 Drawing Sheets

(51) Int. Cl.

| | |
|---|---|
| ***A45B 5/00*** | (2006.01) |
| ***A47C 4/30*** | (2006.01) |
| ***A47C 4/38*** | (2006.01) |
| ***A47C 4/48*** | (2006.01) |
| ***A47C 4/28*** | (2006.01) |
| ***A47C 4/24*** | (2006.01) |
| ***A47C 4/14*** | (2006.01) |

(52) U.S. Cl.
CPC ..... *A47C 4/283* (2013.01); *A47C 4/286* (2013.01); *A47C 4/30* (2013.01); *A47C 4/38* (2013.01); *A47C 4/48* (2013.01); *A47C 9/10* (2013.01)

(56) References Cited

U.S. PATENT DOCUMENTS

| | | | | |
|---|---|---|---|---|
| 9,326,612 | B2 * | 5/2016 | Kim | A47C 9/10 |
| 9,854,882 | B1 * | 1/2018 | Peck | A45B 3/00 |
| 10,285,503 | B2 * | 5/2019 | Graybill | A47C 13/00 |
| 11,140,955 | B2 * | 10/2021 | Hu | A63B 29/08 |
| 11,166,530 | B1 * | 11/2021 | Wilson, Jr. | A45B 5/00 |
| D937,619 | S * | 12/2021 | Kim | D6/708.16 |
| 2015/0374131 | A1 * | 12/2015 | Kim | A47C 4/42 297/440.1 |
| 2016/0338492 | A1 * | 11/2016 | Piretti | A47C 4/24 |
| 2018/0235368 | A1 * | 8/2018 | Graybill | A47C 4/02 |
| 2020/0329875 | A1 * | 10/2020 | Zhang | A47C 4/286 |
| 2021/0015263 | A1 * | 1/2021 | Lah | A47C 4/022 |

FOREIGN PATENT DOCUMENTS

| | | | | |
|---|---|---|---|---|
| KR | 1287868 | B1 * | 7/2013 | A47C 4/02 |
| KR | 10-2017003840 | A * | 1/2017 | A47C 4/02 |
| WO | WO-2016065981 | A * | 5/2016 | A47C 4/02 |
| WO | WO-2018145039 | A1 * | 8/2018 | A47C 13/00 |

* cited by examiner

FOLDABLE CHAIR

TECHNICAL FIELD OF THE INVENTION

The present invention relates to the technical field of chairs as daily necessities, in particular to a portable foldable chair.

BACKGROUND OF THE INVENTION

Chair is a kind of furniture in daily life, and it is a kind of seat with a backrest. Existing chairs are bamboo chairs, wooden chairs, canvas chairs, steel-wood hybrid chairs, etc. Canvas chairs are generally foldable chairs, with the advantages of being light in weight, low in cost, easy to carry around, and popular with travel enthusiasts. Generally, some of canvas chair seats of the existing canvas chairs are integrally sleeved on rear support tubes, while some are mounted in the rear support tubes through some buckles or complicated structures. For ease of use, chairs are not only seats, but should also be endowed with more functions to make human beings more convenient.

Upon inquiry, a Chinese patent CN203378781U (Patent No.: 201320474349.X), titled Ultra-Light Folding Chair, mainly solves the problems that the existing reclining chairs are inconvenient to carry around and difficult to be transported over long distances. It comprises a pair of connecting and mounting blocks, first elastic straps on which top tubes are sleeved are provided between the connecting and mounting blocks, second elastic straps, through which the connecting and mounting blocks are connected to front leg tubes, rear leg tubes, front support tubes and rear support tubes, are provided in the connecting and mounting blocks, and the front and rear leg tubes and the front and rear support tubes are sleeved in the connecting and mounting blocks. The front and rear leg tubes and the front and rear support tubes of the ultra-light folding chair can be disassembled and folded, and then put into a bag, so such chair is easy to carry around and can be transported over long distances, especially suitable for some outdoor enthusiasts. Similar structures can also be found in Chinese patents CN205197528U (Patent No.: 201520878839.5) and CN209769712U (Patent No.: 201920155438.5), which are defective in not making full use of some outdoor sports equipment to fully reduce weight and cost, so there is room for further optimization of design.

SUMMARY OF THE INVENTION

It is an object of the present invention to provide a foldable chair, which makes reasonable use of outdoor equipment, i.e., poles reasonably, so as to make the foldable chair structure more reasonable and simple, quick and easy to install and disassemble, and very easy to carry around.

For achieving the above object, the foldable chair comprising a foldable chair frame and a chair seat made of a flexible material; the chair frame comprising an X-shaped left support frame, an X-shaped right support frame and a connecting crossbar with two ends connecting the left support frame and the right support frame, the chair seat having a top edge, a bottom edge, and a backside, the chair seat connecting to the chair frame through a plurality of connecting pieces disposed on the top and bottom edges of the backside of the chair seat; wherein, each of the left support frame and the right support frame has a detachable pole extending from top to bottom of the chair frame, and the connecting crossbar has two first through holes for the poles to pass through, each of the left support frame and the right support frame has a support tube extending from the bottom edge of the chair seat to the bottom of the chair frame, and correspondingly, the connecting crossbar has two second through holes for the support tubes to pass through, and each pole and the corresponding support tube forms the X-shaped left or right support frame.

Preferably, each support tube further comprises an upper support tube and a lower support tube both are detachably connected to the second through holes of the connecting crossbar.

Preferably, the connecting crossbar, the upper support tubes and the lower support tubes are made from metal tube; each first through holes is located at the end of the connecting crossbar, the middle lower portion of each pole is located inside the corresponding first through hole; each second through hole is radially across at the end of the connecting crossbar, a first elastic rope runs through each upper support tube and the corresponding lower support tube to pull an upper support tube toward the corresponding lower support tube to form the X-shaped left or right support frame with the corresponding respective poles.

Preferably, the outer diameters of each upper support tube and each lower support tube are both greater than the diameter of the each second through hole of the connecting crossbar; the lower support tube has a smaller section at the top end of the lower support tube inserting inside the second through hole, the inner diameter of the upper support tube is adapt to the smaller section for receiving the smaller section of the lower support tube, the top end of the lower support tube is inserted into the lower end of the upper support tube after the smaller section runs through the second through hole.

Preferably, each second through hole is located outer side of the adjacent first through holes on the connecting crossbar; the first elastic rope has two ends, one end of the first elastic rope is connected to the upper support tube, and the other end of the first elastic rope runs through the corresponding second through hole and is connected to the lower support tube.

Preferably, the connecting crossbar has two hollow sleeves inserted in the connecting crossbar, and the hollow sleeves forms the second through holes.

Preferably, the connecting crossbar comprises a left connecting crossbar and a right connecting crossbar detachably connected with each other, and a second elastic rope attaches the left connecting crossbar to the right connecting crossbar.

Preferably, the second through holes and the first through holes are distributed inclined in X shape.

Preferably, the two poles have same structure with an adjustable pole height, and the left support frame and the right support frame are symmetrical located at left and right of the chair frame.

Preferably, the pole comprises an upper pole body and a lower pole body detachably connected to each other; a hand grip portion is disposed at an upper end of the upper pole body, a leg portion is connected to a lower end of the lower pole body; the upper pole body and the lower pole body are detachably connected through a locking sleeve, the lower pole body is inserted into the leg portion and then fixed by a locking sleeve, and the outer end of the connecting crossbar is sleeved on the lower pole body and disposed above the locking sleeve.

Preferably, a socket is disposed at the middle lower portion of the pole, and a fixed pin is inserted into and connected to the socket to position and fixedly connect the connecting crossbar.

Preferably, a plurality of connecting sleeves at the back of the chair seat are made of a flexible material; the two connecting sleeves at the upper end are respectively fitted and inserted into the hand grip portions of the two poles, and the two connecting sleeves at the lower end are respectively fitted and inserted into the upper ends of the left and right upper support tubes.

Compared with the prior art, the present invention has the following advantages. The chair frame takes two poles as the main body and is combined with two sets of support frames consisting of the connecting crossbar and the upper and lower support tubes, so that the chair is easy for installation and disassembly, and the poles may be used as the support frame of the chair while being used for mountaineering. The height of the chair back may be adjusted by adjusting the height of the pole body of the pole, so the chair is suitable for people of different heights, is easy to store and carry around, and reduces weight and cost. Since the chair seat is made of a flexible material, the chair is light in weight, small in size and low in cost. The present invention has the advantages of simple and reasonable structure, easy installation and disassembly, simple manufacture process and low cost, and is especially suitable for carrying around when traveling.

DETAILED DESCRIPTION OF THE INVENTION

Figure 1:
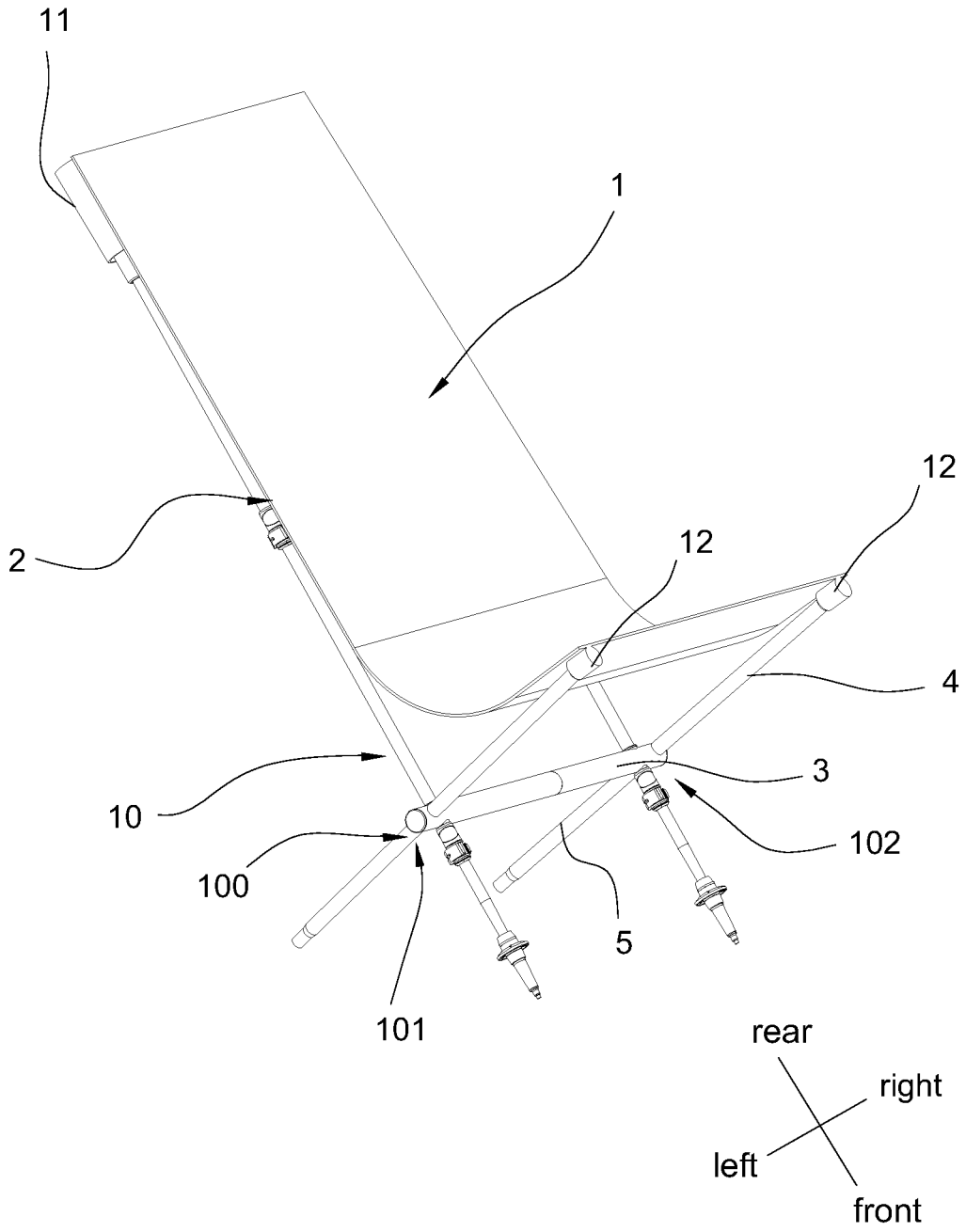
FIG. 1 is a perspective view of a foldable chair according to an Embodiment 1 of the present invention.

The present invention will be further described in detail by embodiments with reference to the accompanying drawings.

Embodiment 1

FIGS. 1-4 show a first embodiment of a foldable chair. The foldable chair comprises a foldable chair frame 10 and a chair seat 1. The chair frame 10 comprises a detachable X-shaped left support frame 101, a detachable X-shaped right support frame 102 and a connecting crossbar 3 with two ends connecting the left support frame 101 and the right support frame 102, each of the left support frame 101 and the right support frame 102 has a plurality of support tubes 100 distributing slantwise from the bottom edge of the chair seat 1 to the bottom of the chair frame 10, and each support tube 100 is detachably connected to each end of the connecting crossbar 3 to form the chair frame 10. The chair seat 1, which is typically rectangular, is made of canvas, cotton cloth, leather and other flexible materials, and a plurality of connecting sleeves 11 and 12 into which both ends of the chair frame 10 are inserted are disposed on left and right sides of upper and lower ends at the back of the chair seat 1. In the embodiment, a plurality of connecting pieces are in form of connecting sleeves but not limited thereto, for example, the connecting pieces may also be tied to the chair frame 10 in the form of straps, or fixedly connected through tube fixing holes on the chair frame 10 or by being hooked in the tube fixing holes on the chair frame 10 in form of hooks, which will not be enumerated herein for conciseness. The key of the present invention lies in that each of the left support frame 101 and the right support frame 102 has a detachable pole 2 extending from top to bottom of the chair frame 10, and the connecting crossbar 3 has two first through holes 34 for the poles 2 to pass through, each of the left support frame 101 and the right support frame 102 has the support tube 100 extending from the bottom edge of the chair seat 1 to the bottom of the chair frame 10, and correspondingly, the connecting crossbar 3 has two second through holes 33 for the support tubes 100 to pass through, and each pole 2 and the corresponding support tube 100 forms the X-shaped left or right support frame. In order to reduce the folded volume, each support tube 100 further comprises an upper support tube 4 and a lower support tube 5 which are connected by a first elastic rope 6. In this way, the outdoor equipment pole 2 may be fully utilized as the support tube of the foldable chair frame 10, thus making it easy to store and carry around, reducing weight and cost while improving the strength of the chair.

Figure 2:
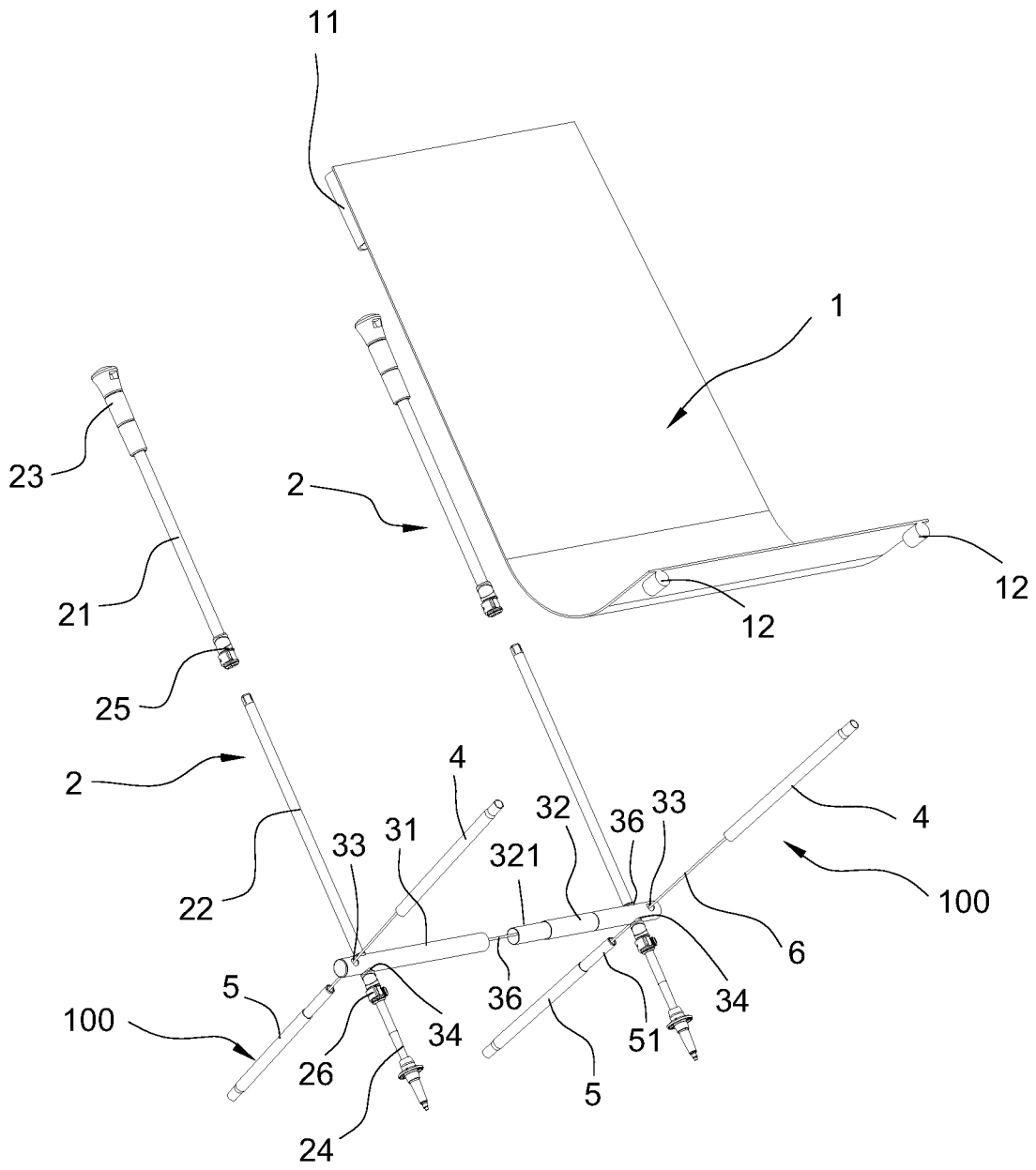
FIG. 2 is an exploded view of FIG. 1.

The specific structure is that the chair frame 10 is preferably formed by assembling two poles 2 of the same structure, the connecting crossbar 3, the upper support tube 4 and the lower support tube 5. The connecting crossbar 3, the upper support tubes 4 and the lower support tubes 5 are made from metal tube, composite material tubes or/and plastic tubes, where the metal tubes may be stainless steel tubes or aluminum tubes, the composite material tubes may be carbon fiber tubes, and the plastic tubes may be ABS tubes. There are two connecting crossbars 3 detachably connected with each other, the connecting crossbar 3 comprises a left connecting crossbar 31 and a right connecting crossbar 32. The left connecting crossbar 31 and the right connecting crossbar 32 are in plug-in connection or threaded connection from the left and right sides, thus facilitating assembly and disassembly thereof. In order to prevent the two crossbars from falling apart after disassembly, a second elastic rope 36 attaches the left connecting crossbar 31 to the right connecting crossbar 32, so that the crossbars may be connected together without falling apart. There are also two sets of the upper support tubes 4 and the lower support tubes 5 on the left and right sides, and first through holes 34 are respectively formed at left and right outer ends of the connecting crossbar 3. Generally, the first through holes 34 are inclined from the upper rear side to the lower front side, and also inclined inward from top to bottom till the connecting crossbar 3 can be sleeved and fixed at middle lower portions of the poles 2. In order to improve the strength of the first through holes 34, a plurality of connectors 35 are connected to upper and lower sides of the through first holes 34. The second through holes 33 are radially disposed at the left and right outer ends of the connecting crossbar 3, the connecting crossbar 3 has two hollow sleeves 37 inserted in the connecting crossbar 3, and the hollow sleeves 37 form the second through holes 33, so as to improve connection strength thereof, and the connecting crossbar 3 may also be simply perforated. Generally, the second through holes 33 are disposed obliquely from an upper front side to a lower rear side, and also inclined inward from top to bottom. The first elastic rope 6 runs through the second through hole 33, each second through hole 33 is radially across at the end of the connecting crossbar 3, the first elastic rope 6 runs through each upper support tube 4 and the corresponding lower support tube 5 to pull an upper support tube 4 toward the corresponding lower support tube 5 to form the X-shaped left or right support frame 101 and 102 with the corresponding respective poles 2, as shown in FIGS. 1-2.

Preferably, the pole 2 comprises an upper pole body 21 and a lower pole body 22 detachably connected through a locking sleeve 25 having a self-locking mechanism. A hand grip portion 23 is disposed at an upper end of the upper pole body 21, a leg portion 24 is connected to a lower end of the lower pole body 22, and the lower pole body 22 is inserted into the leg portion 24 and then fixed by a locking sleeve 26 having a self-locking mechanism. Such structure is a conventional design of the pole 2, as shown in FIG. 2. The first through holes 34, through which the connecting crossbar 3 is sleeved and fixed at a middle lower portion of the lower pole body 22, is radially disposed at the left and right outer ends of the connecting crossbar 3, so that the connecting crossbar 3 is positioned above the locking sleeve 26. Since the diameter of the locking sleeve 26 is usually greater than that of the first through hole 34, the connecting crossbar 3 can be positioned above the locking sleeve 26, thereby ensuring that the chair is solid, and not easy to fall apart but easy to locate and use. Of course, it is also possible to use the pole 2 connected not by the locking sleeve as long as the upper pole body 21 and the lower pole body 22 can be detachably connected and the dimensions are well matched. A reduced insertion portion 321 inserted with an inner end of the left connecting crossbar 31 is disposed at an inner end of the right connecting crossbar 32, and each second through hole 33 is located outer side of the adjacent first through holes 34 at the outer ends of the left connecting crossbar 31 and the right connecting crossbar 32; the first elastic rope 6 has two ends, one end of the first elastic rope 6 is connected to the upper support tube 4, and the other end of the first elastic rope 6 runs through the corresponding second through hole 33 and is connected to the lower support tube 5. Generally, the outer diameters of each upper support tube 4 and each lower support tube 5 are both greater than the diameter of the each second through hole 33 of the connecting crossbar 3; the lower support tube 5 has a smaller section 51 at the top end of the lower support tube 5 inserting inside the second through hole 33, the inner diameter of the upper support tube 4 is adapt to the smaller section 51 for receiving the smaller section 51 of the lower support tube 5, the top end of the lower support tube 5 is inserted into the lower end of the upper support tube 4 after the smaller section 51 runs through the second through hole 33. Of course, the upper support tube 4 and the lower support tube 5 may be connected by inserting, and may also be in threaded connection. Generally, to improve the landing capacity of the support tubes, a support leg is disposed at the lower end of the lower support tube 5.

Figure 3:
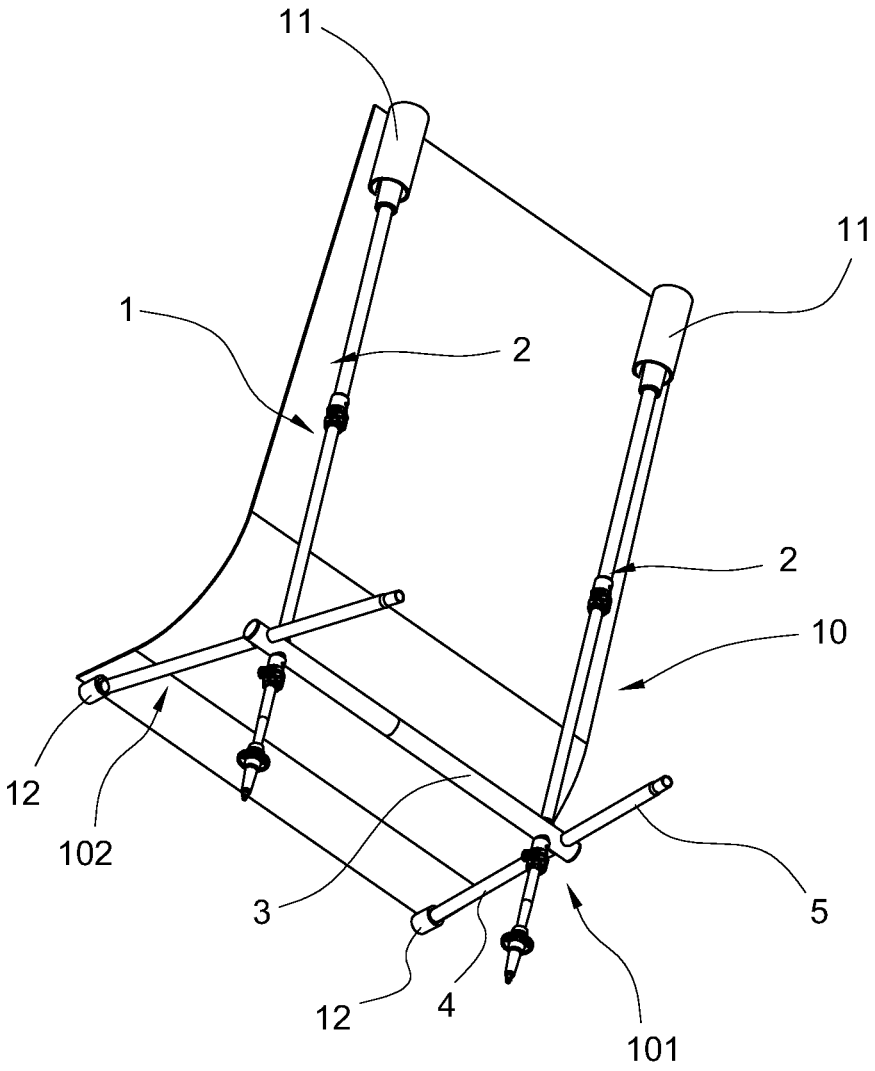
FIG. 3 is a perspective view of a back side of the foldable chair according to Embodiment 1 of the present invention.
Figure 4:
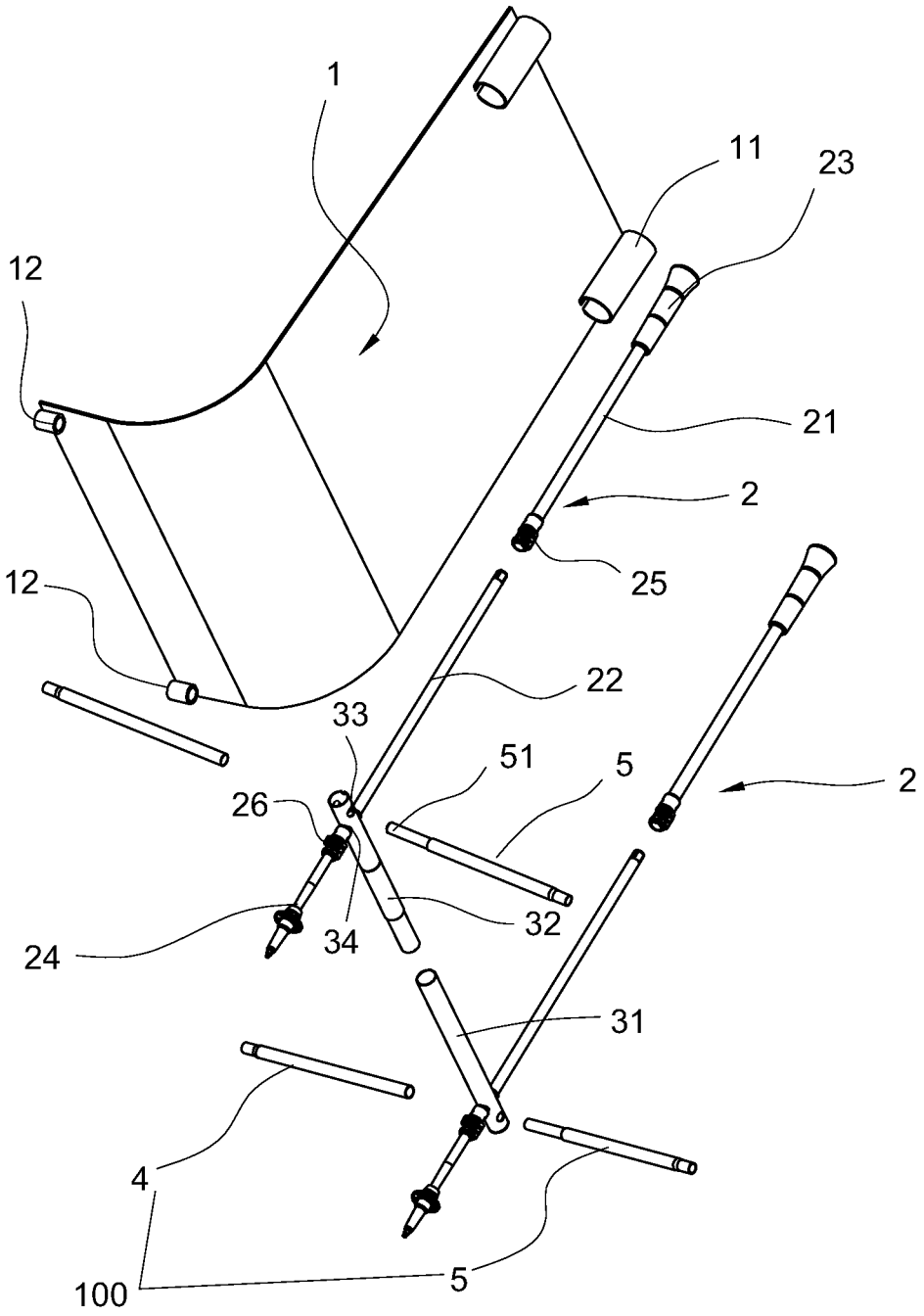
FIG. 4 is an exploded view of FIG. 3.

The connecting sleeves 11 and 12 at the back of the chair seat 1 are sleeves made of canvas, cotton cloth and leather, the two connecting sleeves 11 at the upper end are respectively fitted and inserted into the hand grip portions 23 of the two poles 2, and the two connecting sleeves 12 at the lower end are respectively fitted and inserted into the upper ends of the left and right upper support tubes 4, thus forming a portable foldable chair, as shown in FIG. 3.

A specific installation process is as follows: the upper support tube 4 and the lower support tube 5 constituting the support tube 100 are connected by the first elastic rope 6 to integrate with the connecting crossbar 3, the upper pole body 21 and the lower pole body 22 of the pole 2 are separated, the upper end of the lower pole body 22 runs through the first through hole 34 of the connecting crossbar 3, the connecting crossbar 3 is rested on the locking sleeves 26, and then the upper pole body 21 is inserted into the crossbar and adjusted in position to form the chair frame 10; the leg portion 24 is adjusted to the proper position of the chair frame 10, and finally the chair seat 1 is sleeved on the chair frame 10 through the connection sleeves 11 and 12.

When not in use at ordinary times, the chair seat 1 and the chair frame 10 can be easily disassembled, the pole 2 can be used for mountaineering, and the upper support tube 4 and the lower support tube 5 can be pulled apart and folded together with the connecting crossbar 3 for easy storage and portability, thereby greatly reducing weight and volume.

Embodiment 2

Figure 5:
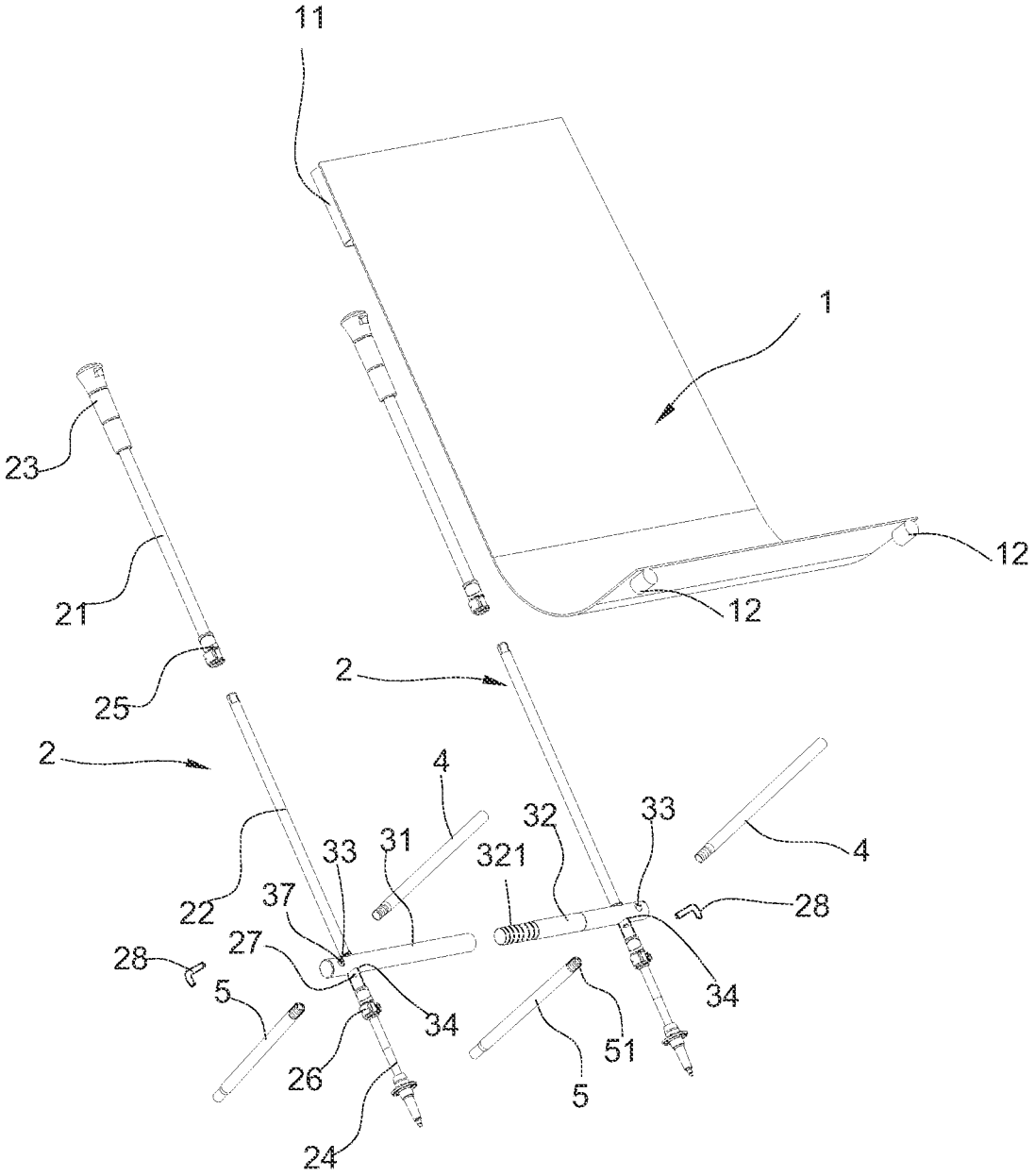
FIG. 5 is an exploded view of the foldable chair according to an Embodiment 2 of the present invention.

FIG. 5 shows a second embodiment of a foldable chair. The foldable chair differs from the Embodiment 1 in that, the connecting crossbar 3 is formed by the left connecting crossbar 31 and the right connecting crossbar 32 through threaded connection, i.e., the original insertion section needs to be modified into a threaded section. The upper support tube 4 and the lower support tube 5 are also in threaded connection with the connecting crossbar 3, i.e., the upper support tube 4 and the lower support tube 5 adopt an external thread section, while the second through holes 33 of the connecting crossbar 3 are internal thread holes. A socket 27 is disposed at the middle lower portion of the pole 2, and a fixed pin 28 is inserted into and connected to the socket 27 to position and fixedly connect the connecting crossbar 3. Other structures are similar to those in Embodiment 1.

The protection scope of the present invention is not limited to each embodiments described in this description. Any changes and replacements made on the basis of the scope of the present invention patent and of the description shall be included in the scope of the present invention patent.

The invention claimed is:

1. A foldable chair, comprising:

a foldable chair frame and a chair seat made of a flexible material;

the chair frame comprising an X-shaped left support frame, an X-shaped right support frame and a connecting crossbar with two ends connecting the left support frame and the right support frame, the chair seat having a top edge, a bottom edge, and a backside, the chair seat connecting to the chair frame through a plurality of connecting pieces disposed on the top and bottom edges of the backside of the chair seat;

wherein, each of the left support frame and the right support frame has a detachable pole extending from top to bottom of the chair frame, and the connecting crossbar has two first through holes for the poles to pass through, each of the left support frame and the right support frame has a support tube extending from the bottom edge of the chair seat to the bottom of the chair frame, and correspondingly, the connecting crossbar has two second through holes for the support tubes to pass through, each support tube further comprises an upper support tube and a lower support tube, both detachably connected to the second through holes of the connecting crossbar, the connecting crossbar, the upper support tubes and the lower support tubes are made from metal tube;

each first through hole is located at the end of the connecting crossbar, the middle lower portion of each pole is located inside the corresponding first through hole;

each second through hole is located on an outer side of the adjacent first through holes on the connecting crossbar and radially across at the end of the connecting crossbar, a first elastic rope runs through each upper support tube and the corresponding lower support tube to pull an upper support tube toward the corresponding lower support tube to form the X-shaped left or right support frame with the corresponding respective poles, the outer diameters of each upper support tube and each lower support tube are both greater than the diameter of the each second through hole of the connecting crossbar, the lower support tube has a smaller section at the top end of the lower support tube inserting inside the second through hole, the inner diameter of the upper support tube adapted for receiving the smaller section of the lower support tube, the top end of the lower support tube is inserted into the lower end of the upper support tube after the smaller section runs through the second through hole, the first elastic rope has two ends, one end of the first elastic rope is connected to the upper support tube, and the other end of the first elastic rope runs through the corresponding second through hole and is connected to the lower support tube, each pole and the corresponding support tube forms the X-shaped left or right support frame, and the connecting crossbar has two hollow sleeves inserted in the connecting crossbar, and the hollow sleeves form the second through holes.

2. The foldable chair of claim 1, wherein the connecting crossbar comprises a left connecting crossbar and a right connecting crossbar detachably connected with each other, and a second elastic rope attaches the left connecting crossbar to the right connecting crossbar.

3. The foldable chair of claim 1, wherein the second through holes and the first through holes are distributed inclined in X shape.

4. The foldable chair of claim 1, wherein the two poles have same structure with an adjustable pole height, and the left support frame and the right support frame are symmetrical located at left and right of the chair frame.

5. The foldable chair of claim 1, wherein the pole comprises an upper pole body and a lower pole body detachably connected to each other;

a hand grip portion is disposed at an upper end of the upper pole body, a leg portion is connected to a lower end of the lower pole body;

the upper pole body and the lower pole body are detachably connected through a locking sleeve, the lower pole body is inserted into the leg portion and then fixed by a locking sleeve, and the outer end of the connecting crossbar is sleeved on the lower pole body and disposed above the locking sleeve.

6. The foldable chair of claim 1, wherein a socket is disposed at the middle lower portion of the pole, and a fixed pin is inserted into and connected to the socket to position and fixedly connect the connecting crossbar.

7. The foldable chair of claim 1, wherein a plurality of connecting sleeves at the back of the chair seat are made of a flexible material;

two connecting sleeves at the upper end are respectively fitted and inserted into hand grip portions of the two poles, and the two connecting sleeves at the lower end are respectively fitted and inserted into the upper ends of the left and right upper support tubes.

* * * * *